US006122890A

United States Patent [19]

Pollitt

[11] Patent Number: 6,122,890

[45] Date of Patent: Sep. 26, 2000

[54] TILES AND FLOOR SURFACES

[75] Inventor: Clifford Bruce Pollitt, Warrington, United Kingdom

[73] Assignee: Cairn Holdings (UK) Limited, Manchester, United Kingdom

[21] Appl. No.: 09/011,580

[22] PCT Filed: Aug. 13, 1996

[86] PCT No.: PCT/GB96/01969

§ 371 Date: Feb. 11, 1998

§ 102(e) Date: Feb. 11, 1998

[87] PCT Pub. No.: WO97/07303

PCT Pub. Date: Feb. 27, 1997

[30] Foreign Application Priority Data

| | | | |
|---|---|---|---|
| Aug. 15, 1995 | [GB] | United Kingdom | 9516682 |
| Oct. 23, 1995 | [GB] | United Kingdom | 9521650 |
| Oct. 25, 1995 | [GB] | United Kingdom | 9521824 |

[51] Int. Cl.[7] ..... E04F 15/00

[52] U.S. Cl. ..... 52/747.11; 52/387; 52/389; 52/390

[58] Field of Search ..... 52/389, 387, 747.11, 52/390

[56] References Cited

U.S. PATENT DOCUMENTS

| | | | |
|---|---|---|---|
| 533,807 | 2/1895 | Hettich | 52/747.11 |
| 800,655 | 10/1905 | Kitsee | 52/747.11 |
| 1,106,168 | 8/1914 | Thomas | 52/387 |
| 1,637,580 | 8/1927 | Lowry et al. | 52/747.11 |
| 1,643,879 | 9/1927 | Meyer | 52/747.11 |
| 1,836,964 | 12/1931 | Grigsby et al. | 52/387 |
| 2,114,710 | 4/1938 | Holcomb | 52/387 |
| 4,052,825 | 10/1977 | Larsson | 52/747.11 |
| 4,862,668 | 9/1989 | DeGooyer | 52/747.11 |
| 4,932,182 | 6/1990 | Thomasson | 52/387 |
| 4,953,341 | 9/1990 | Joos | 52/747.11 |
| 5,238,721 | 8/1993 | Nakazawa | 52/387 |

OTHER PUBLICATIONS

Hawley's Condensed Chemical Dictionary, Eleventh Edition, pp.932–933, Dec. 1987.

*Primary Examiner*—Carl D. Friedman
*Assistant Examiner*—Dennis L. Dorsey
*Attorney, Agent, or Firm*—Bergert & Bergert

[57] ABSTRACT

A method of forming a tiled floor without adhesive beneath the tiles comprises laying the tiles, applying filler between adjacent tiles after laying, and holding the tiles in relative position. A flexible sheet with apertures can be laid on a substrate and the apertures filled with grouting material and the tiles laid on the sheet, the spaces between the tiles receiving filler material. The tiles may have a groove in peripheral sides to provide a keying effect for the filler material. The filler material may be settable after application and hold the tiles in position.

11 Claims, 8 Drawing Sheets

TILES AND FLOOR SURFACES

This Invention relates to tiles and floor surfaces in particular tiled surfaces e.g. floors, kitchen tops and other working surfaces.

The term tiles is intended to include floor elements such as wood blocks, bricks, tiles e.g. of ceramic or clay or concrete or brick, and paviours.

U.S. Pat. No. 1,643,879 discloses a method of forming a floor surface from tiles comprising laying the tiles on a substrate without adhesive beneath the tiles, and applying filler material between adjacent tiles after laying to hold the tiles in relative position.

According to one aspect of the invention a method of forming a floor surface from tiles comprises laying the tiles on a substrate without adhesive beneath the tiles, and applying filler material between adjacent tiles after laying to hold the tiles in relative position characterised in that the filler material is non-adhesive.

The tiles may be joined around their peripheries by the filler material.

The method may comprise laying a flexible sheet on the substrate and laying the tiles above the sheet.

The sheet may be apertured with filler material in the apertures.

A screed may be laid on the sheet and the tiles laid on the screed. The screed may be of filler material.

The filler material may be settable.

According to another aspect of the invention a tile for use in a method as above has a recess in a peripheral face for receipt of filler material characterised in that the recess has a re-entrant portion. The tile may have a recess e.g. a groove in an underface.

The invention includes a floor formed by a method as above.

The invention may be performed in various ways and some specific embodiments with possible modifications will now be described by way of example with reference to the accompanying schematic drawings in which:

FIG. 1 is a plan view of a floor;

FIGS. 1*a* to 1*d* show examples of patterns of laid tiles;

FIG. 2 and 3 are sections through parts of the floor;

FIG. 2*a* is a plan view of a spacer;

Figure 12:
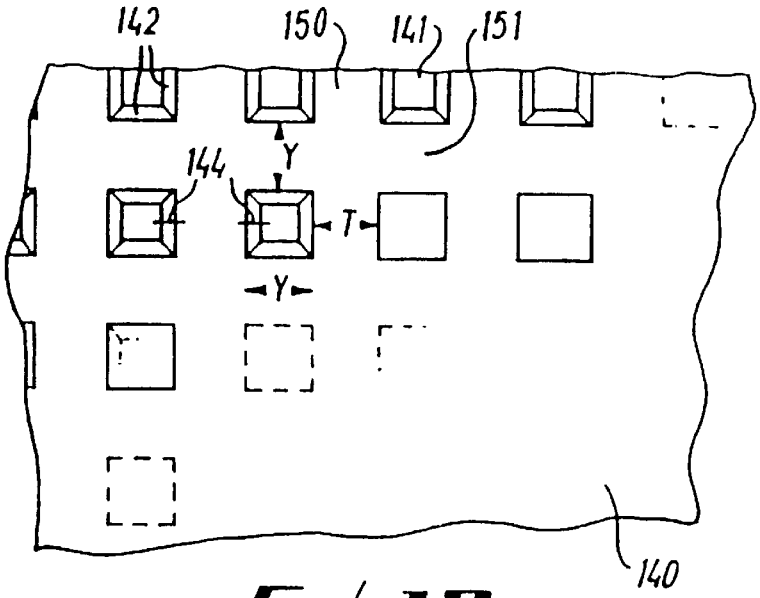
Figure 12A:
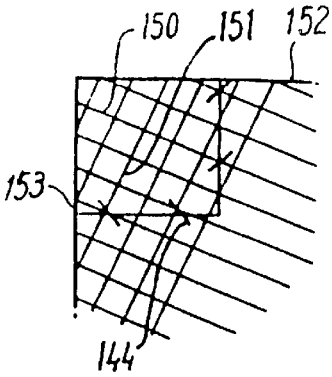
Figure 13:
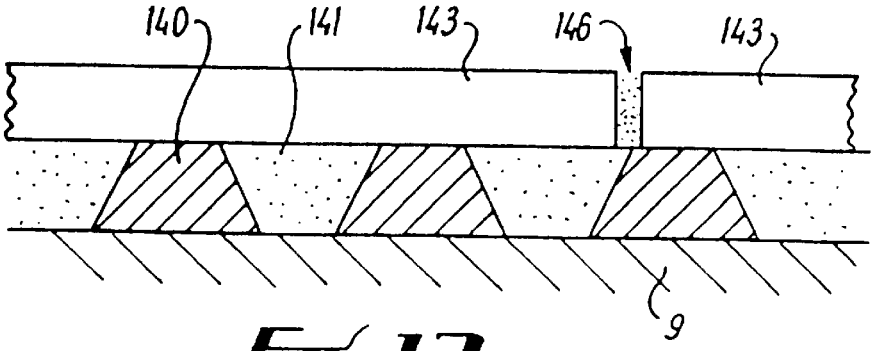
Figure 14:
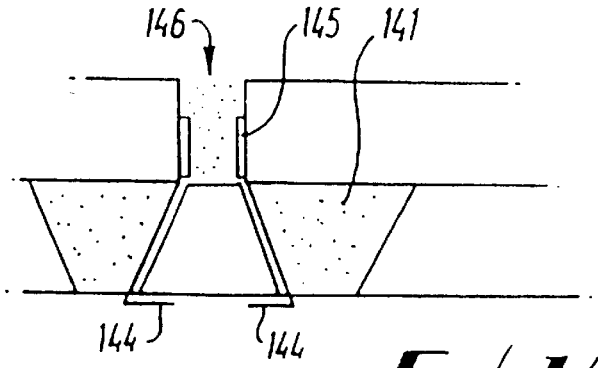

FIGS. 8 to 11*a* show other arrangements;

FIGS. 12 and 13 are plan and section views of a sheet;

FIG. 12A shows part of a sheet;

FIG. 14 is a section showing a clip; and

Figure 15:
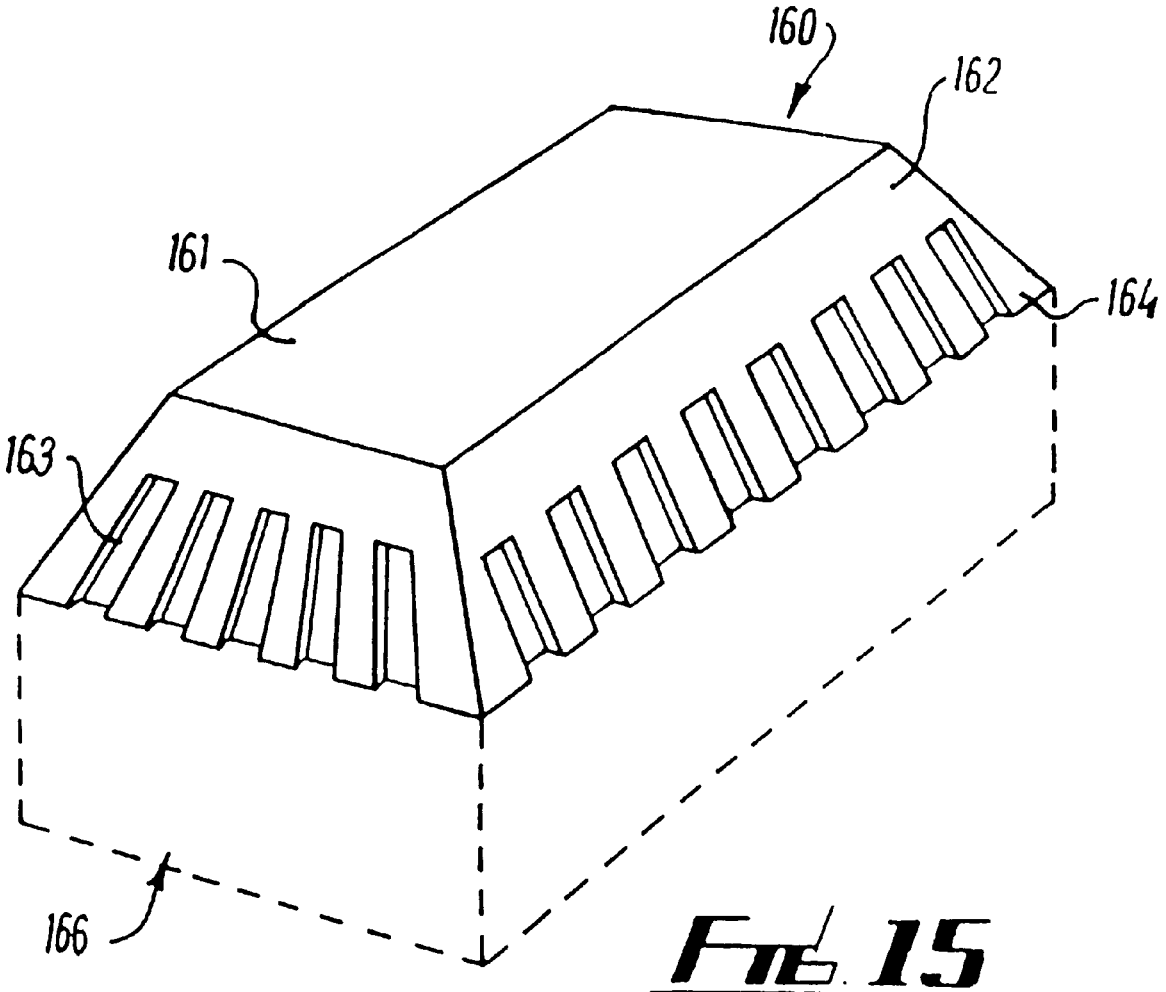

FIG. 15, 15A show a further arrangement.

Figure 1:
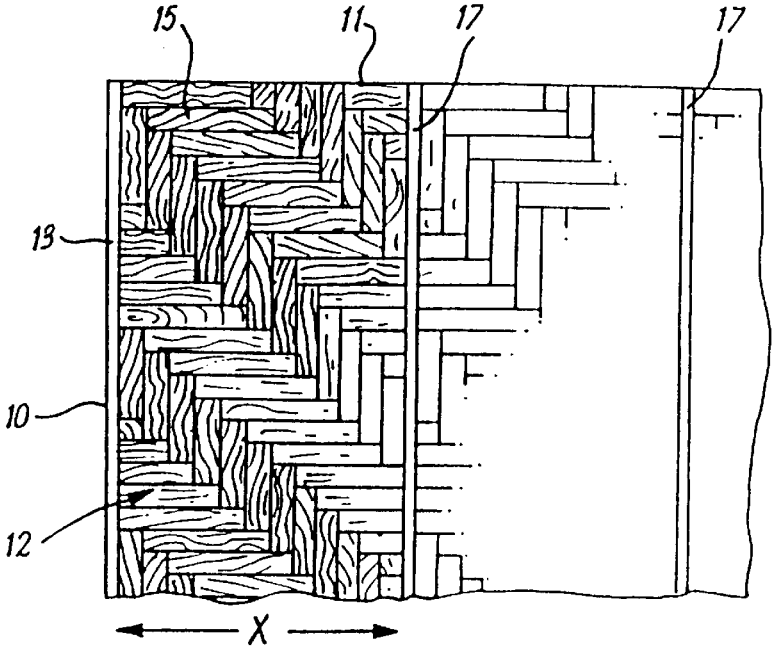
Figure 2:
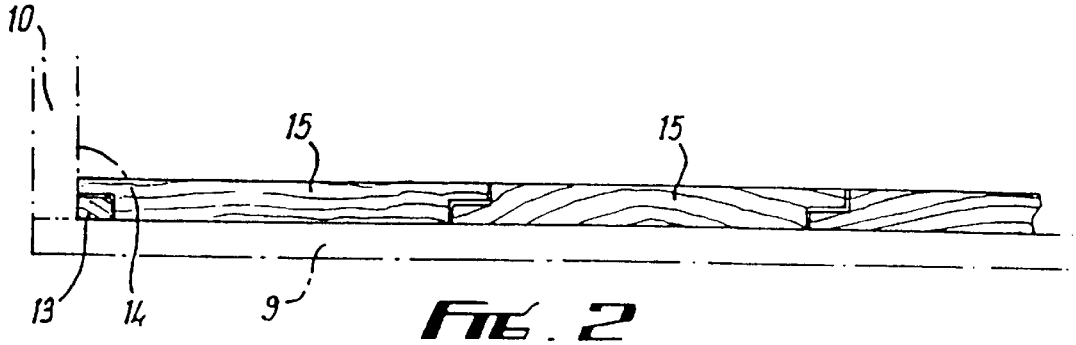
Figure 2A:
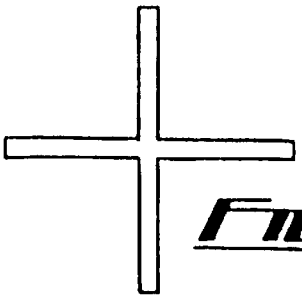

Referring to the drawings, FIG. 1 shows parts of two side walls 10, 11 of a room and flooring 12 in the room. In laying the floor 12 a strip 13 of, for example, wood is laid against the bottom inner face 14 of wall 10. A plurality of flat floor elements 15, for example, wood blocks or bricks or tiles, are then laid on the surface which supports the floor, for example, a flat concrete base 9. The elements 15 are laid if desired in a pattern with adjacent elements abutting along their straight sides. After a certain length X of floor has been laid, a cross-member 17, for example of wood or L-shaped thin non-ferrous metal, is placed on the base 9 and moved to place the floor X under compression between strip 13 and the member 17 is then fixed in place, for example, by securing to the base 9 by bolts or screws or nails. The individual elements 15 are not secured to the base 9. Any small gaps between adjacent elements can be filled with a suitable filler e.g. non-cementitious grouting material for both thin and thicker elements. A grouting material, when it sets after filling, assists in holding the tiles in relative position. In some cases a suitably shaped plastics positioning spacer, with arms for example 2 mm or more wide, may be placed between adjacent elements 15, for example as in FIG. 2*a*.

This process is repeated until the floor is covered with a final strip similar to strip 13 adjacent the wall opposite wall 10.

Figure 3:
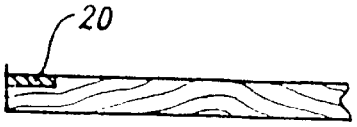
Figure 1A:
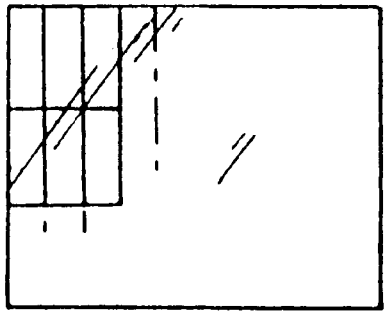
Figure 1B:
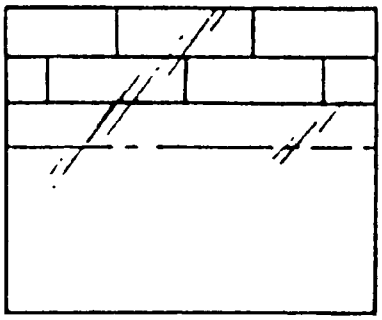
Figure 1C:
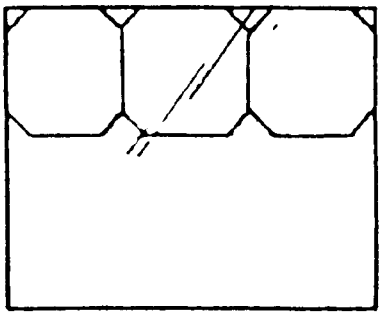
Figure 1D:
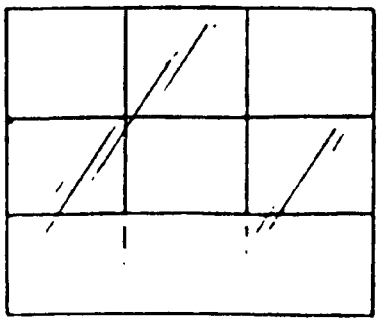
Figure 5:
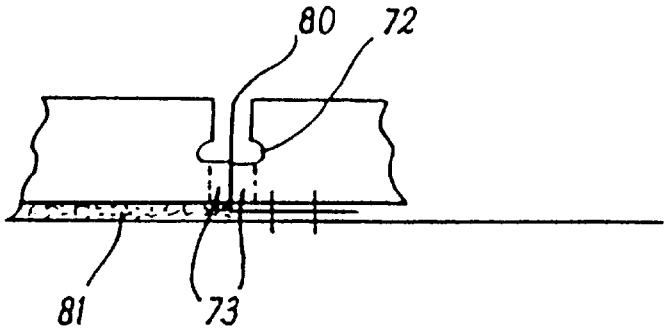
FIG. 5 is a side view of part of a joint.

The strips 13, 15 can be covered by decorative strips 20 (FIG. 3) or the adjacent elements 15 can be shaped to overlie the strips 13 (FIG. 2) or the joint 17 can be hidden (FIG. 5).

The distance X, FIG. 1 is selected such that the floor is not subject to unacceptable buckling.

The strip 13 is preferably secured to base 9.

By this method of floor laying the necessity to secure each floor element 15 to an underbase, e.g. by adhesive, is avoided.

FIGS. 1*a* to 1*d* show various patterns of tile laying for example.

Figure 4:
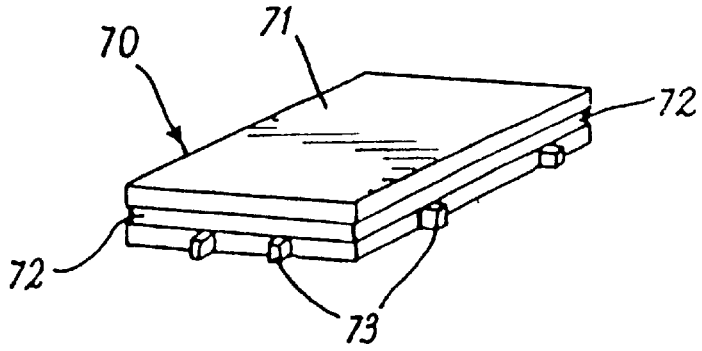
FIG. 4 is a perspective view of a tile.

FIGS. 4 and 5 show another arrangement in which each tile 70 has a top 71 and a peripheral groove 72 and, on each side, one or more spacer lugs 73 which can be integral with the tile 70 or separate therefrom. Typically, the lugs 73 are below the groove 72. Tiles 70 are laid in a desired manner on a substrate, for example a concrete or timber or bitumen floor possibly with an interposed flexible plastics sheet or a plastics sheet and adjacent tiles are spaced by lugs 73. A grout is then injected into the groove 72 and the space between the tiles around the tile peripheries, without contacting the underfaces of the tiles, to hold the assembly in place and the tiles in relative position. A cross-member 80 similar to element 17 may additionally hold the tiles in place under lateral compressing force before application of the grout. The member 80 may be screwed to the substrate or sheet. If desired a thin layer 81 of sand or other suitable material for example vermiculite or granulated cork may be on the substrate or sheet to assist in levelling of the tiles.

The lugs 73 provide evenness of spacing between tiles and evenness of joints. The lugs 73 may provide a minimum joint width of for example 4 mm. The lugs may be on only two opposite sides and different sides may have different numbers and positioning of the lugs. The assembly may be under lateral pressure as above.

The filler material is of a loose or flowable consistency prior to application as a filler.

Figure 6:
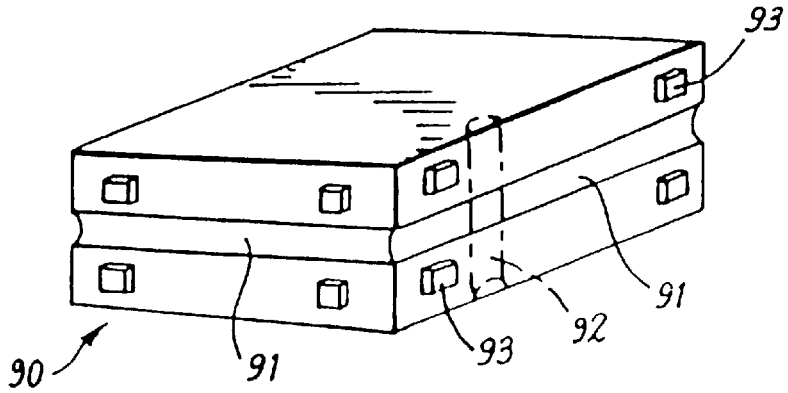
FIG. 6 is a perspective view of a tile.

FIG. 6 illustrates an arrangement for internal or external (out of doors) flooring or paving.

A clay or concrete paving element is laid either onto a concrete or other rigid base, or alternatively is laid onto a flexible base consisting of compacted stone and sand, or other similar surface.

The paving elements 90 for example are either rectangular or square in clay, stone or other similar material and the elements are grooved around the edges horizontally and/or vertically 91, 92 during the manufacturing process and also have spacer lugs 93 incorporated at the time of manufacture to allow consistent and known jointing widths. These spacer lugs 93 are sized to give a minimum joint of 4mm wide. When laying externally, an edge of the area to be paved is provided with a restraint either concreted or screwed into place to form a firm barrier up to which the paving elements can commence to be laid. At regular intervals a lateral restraining strip e.g. strip 17 may be incorporated to ensure the paving elements are firmly held in position.

After laying the joints between adjacent elements 90 are filled with a mixture of dry sand and a settable pointing compound to ensure an inter-lock of the elements to hold them in relative position. In some cases they may be held in position without substantial lateral force, by the settable filler material.

There may be a plurality of vertical grooves 92 on each side of the element 90.

Figure 7:
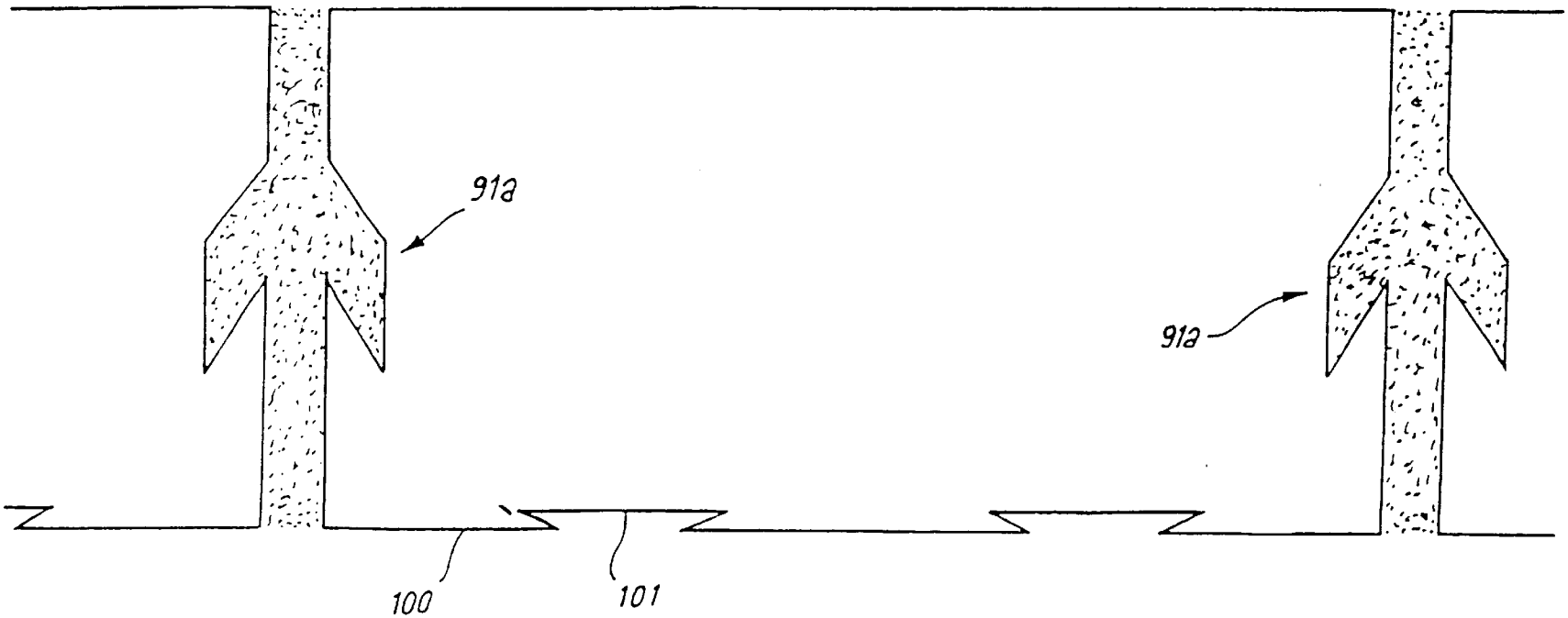
FIG. 7 is a side view of part of a tile layer.

In FIG. 7 a tile is similar to FIG. 6 but the groove 91*a* is not symmetrical about a horizontal plane but, in the example shown, is inclined downwards to provide a re-entrant portion and to provide an added keying effect resisting lateral separation between adjacent tiles. Grooves 92 and/or spacers 93 may optionally be provided.

Also shown in FIG. 7 is a further possible modification in which the underface 100 of the tile is not flat but for example has one or more parallel grooves 101 (with or without grooves 91, 92). There may be grooves similar to grooves 101 extending transverse to the grooves 101.

The tile/paver may be laid on a thin layer of particulate material e.g. sand which acts to provide a substantially flat surface.

Alternatively, the tile/paver can be laid on a screed of a loose or flowable mixture of polybutadiene and dry sand which sets after the tiles are laid to hold the tiles in place when they are grouted with the same material, alleviating the need to have tiles with a groove on either the side or underneath. This makes it possible to lay most ungrooved tiles without using any adhesive, that is, a substance which is already adhesive when applied to a surface or is sticky when touched. This is in contrast to a filler material like sand or a material which may have a holding effect when set e.g. a cementitious grout which has a bonding effect or the mixture of dry sand and polybutadiene which holds the element by close contact rather than a bonding.

The grouting or filler material in the various embodiments may comprise a mixture of dry (e.g. kiln dried) quartz sand and polybutadiene e.g. from 2 to 4% by weight of the mixture which hardens after mixing (and after application as filler or grouting). This mixture can be laid on a base surface to provide a level surface and the tiles then laid and the mixture enters into grooves 101 to provide a key similar to a tongue and groove, or the subsequent grouting with the mixture into gaps between tiles causes at least part of grooves 101 to receive hardenable grouting material which is supplied to the gaps between the tiles and to grooves 91, 92.

The use of a mixture of dry sand and polybutadiene allows the tiles to be relatively easily lifted and re-used or replaced even though the tiles are firmly in place after laying, because unlike cementitious grouts and screeds the mixture when set has little bonding to the tiles. A tile laid on a cementitious screed is individually held whereas a tile laid on a mixture of sand of polybutadiene is largely held by being in an assembly of laid tiles. Attempting to lift a tile in a cementitious grout may tend to break the tile.

Figure 8:
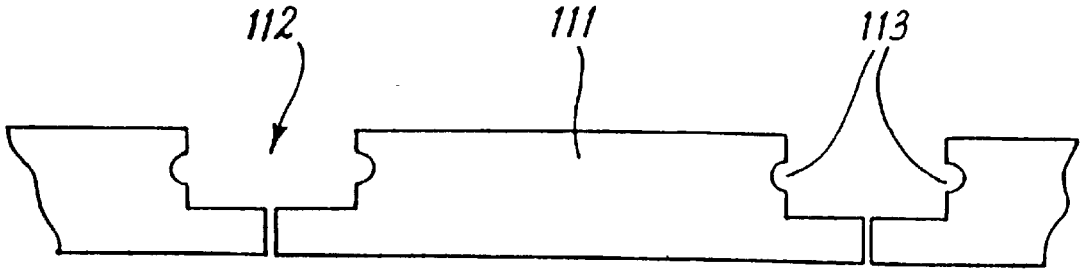
Figure 9:
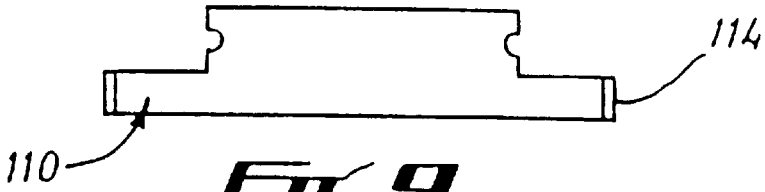
Figure 10:
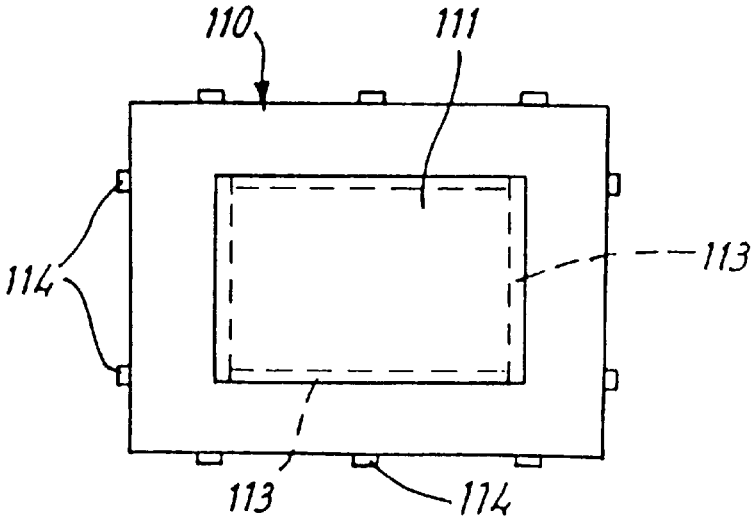

A further embodiment is shown in FIGS. 8 to 10 in which are side, side and plan views of a tile having a base 110 and a central upstanding part 111. The tile is for internal or external use and may be in any suitable material, for example clay, concrete, ceramic, terracotta.

The gap or joint 112 between parts 111 of adjacent tiles may be filled as above but may be filled in a lower portion by sand and in an upper portion by a mixture of sand and polybutadiene as above.

Peripheral grooves 113 flanking the joint and spacer extensions 114 like lugs 93 between adjacent tiles can be provided as above.

Figure 11:
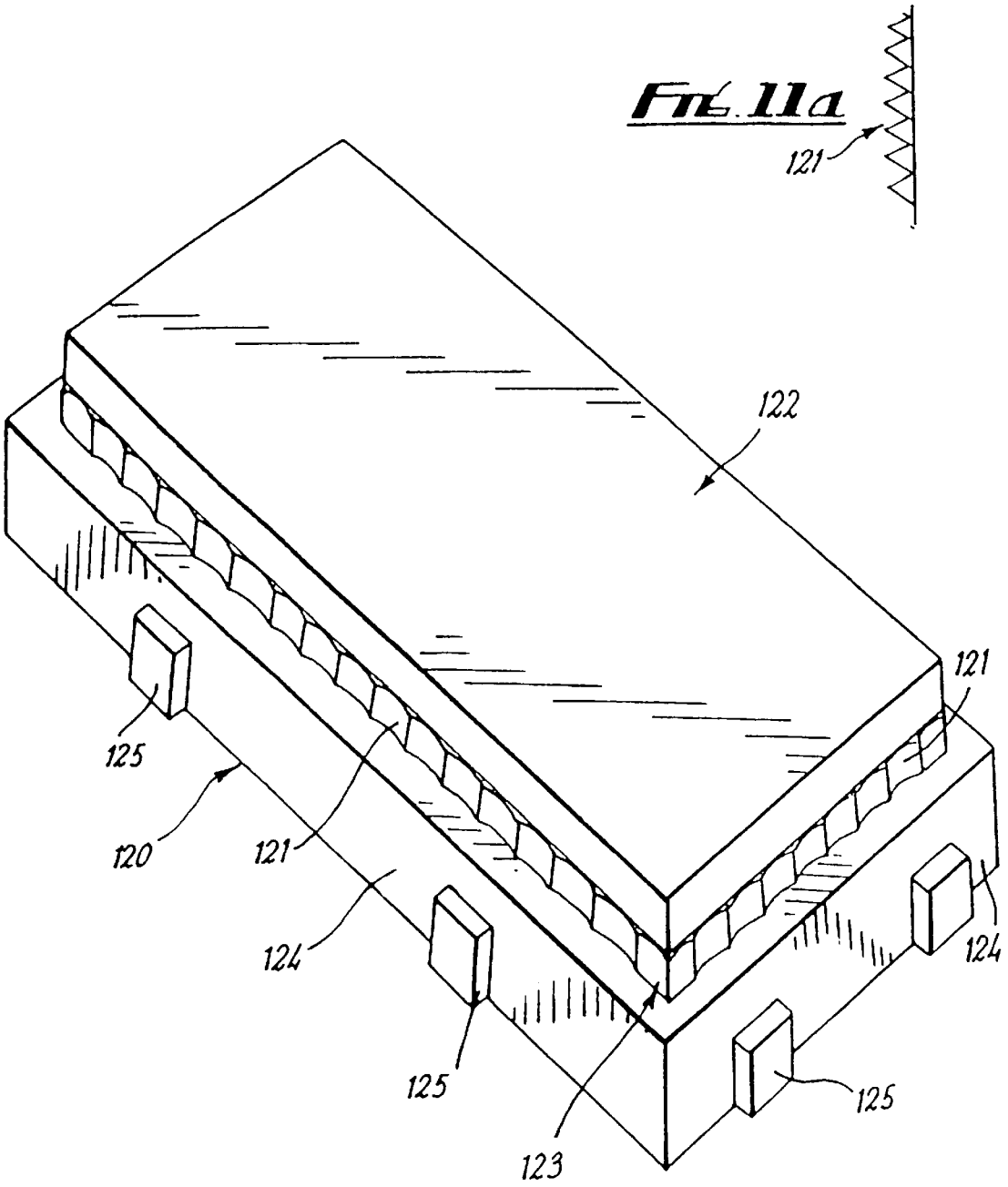

FIG. 11 shows a further example of tile or paver 120 with a fluted portion 121. The portion 121 can be a lower part of an upper inset portion 122 on a lower wider portion 124. Corner parts 123 may be flat. Spacers 125 can be provided as above. Fluting results in an improved key for the grouting or filler material. As shown in FIG. 11 a the fluting can be a saw-tooth form.

FIGS. 12, 13 show a further arrangement in which a flexible thin sheet 140 e.g of plastics is in the form of a lattice with apertures 141 in a regular square away and having sides 142 which incline inwards as they extend downwards. For example the apertures may be 10 mm square and the spacing Y may be 2 mm and the spacing T may be 2 mm. The sheet 140 is placed on a substantially flat substrate 9 and the tiles 143 laid on to the sheet 140 after the apertures 141 have been filled with a non-bonding grouting material e.g. a mixture of sand and polybutadiene as above. The tiles are preferably grooved in any of the ways mentioned above and with spacers. In some cases the spacers may be provided by thin clips 144 which embrace an edge of an aperture 141 and have an upstanding part 145 against which a side of a tile can abut. The joints 146 between tiles are then formed in any of the ways above. The substrate could have a top levelling screed. The sheet may be fixed to the substrate e.g. by nails or screws.

As shown in FIG. 12*a*, the sheet 140 is laid on the floor with the lengths 150, 151 of the lattice at an angle to the sides 152, 153 of the room so that the sides of a tile 154 intersect a number of apertures 141 to provide locations for clips 144.

The material in apertures 141 may because of the shape of the apertures press on the sheet 140 and assist in holding the sheet in place.

Figure 15A:
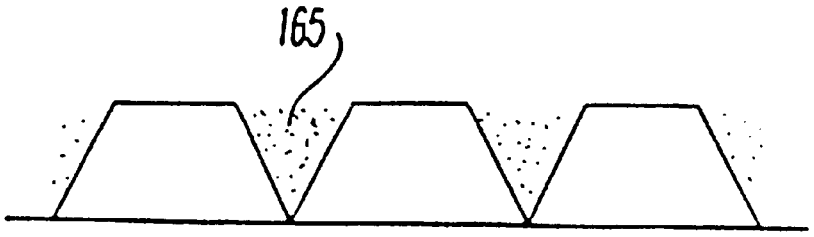

FIGS. 15 and 15A show a further example of square or rectangular paver 160 having top face 161 and inclined side faces 162, the lower portions of which are formed with a number of recesses 163, for example extending upwards from the lower edge 164 for receipt of filler material as shown in the filler material 165 as shown in the end view of FIG. 15A; the width of the top of the joint may for example be between 5 mm and 6 mm. The shape of the recesses 163 can be varied for example of uniform cross-section or be curved to have a maximum cross-section mid-way the ends. The recesses 163 may be on all sides or two opposed sides. If desired the paver 160 may include a flat sided base portion 166 (not shown in FIG. 15A)

Instead of grooves, one or more recesses may be formed in one or more of the tile side surfaces.

To obtain waterproofing, an impregnating sealant may be applied to exposed surfaces of the grouting material after this has set.

Tiles or other floor elements laid as above are easy to lift, e.g. for maintenance or replacement, restoration of a peripheral joint being relatively straight-forward.

The invention can be applied to the formation or laying of other indoor surfaces e.g kitchen tops or working surfaces.

What is claimed is:

1. A method of forming a floor surface from tiles comprising laying the tiles on a substrate without adhesive beneath the tiles, and applying filler material between adjacent tiles after laying to hold the tiles in relative position; characterized in that the filler material is a settable mixture containing dry particulate material and polybutadiene and is non-adhesive.

2. A method as claimed in claim 1, characterized in that a flexible sheet is laid on the substrate and the tiles are laid on the flexible sheet.

3. A method as claimed in claim 2, characterised in that the flexible sheet is apertured and filler material is placed in the apertures.

4. A method as claimed in any one of the preceding claims, characterized in that a screed of filler material is laid and the tiles are laid on the screed.

5. A method as claimed in claim 2, characterized in that a screed of filler material is laid on the sheet and the tiles are laid on the screed.

6. A floor surface formed by a method as claimed in claim 1.

7. A method as claimed in claim 1, characterized in that the filler material is a mixture of dry sand and polybutadiene.

8. A tile for use in the method as claimed in claim 1, in which the tile has a recess in a peripheral face for receipt of filler material, characterized in that the recess has a re-entrant portion.

9. A tile as claimed in claim 8, characterized in that an underface of the tile has a recess.

10. A tile as claimed in claim 9, characterised in that the recess in the underface is in the form of a groove.

11. A tile as claimed in claim 10, in which the groove is narrower at the underface than at a location spaced inwardly from the underface.

* * * * *